US010604291B2

(12) United States Patent
Hutter et al.

(10) Patent No.: US 10,604,291 B2
(45) Date of Patent: Mar. 31, 2020

(54) APPARATUS AND METHOD FOR HANDLING ARTICLES

(71) Applicant: KRONES Aktiengesellschaft, Neutraubling (DE)

(72) Inventors: Alban Hutter, Reit im Winkl (DE); Wolfgang Fechter, Rosenheim (DE); Roland Hofstetter, Rott am Inn (DE)

(73) Assignee: Krones Aktiengesellschaft, Neutraubling (DE)

( * ) Notice: Subject to any disclaimer, the term of this patent is extended or adjusted under 35 U.S.C. 154(b) by 504 days.

(21) Appl. No.: 14/886,230

(22) Filed: Oct. 19, 2015

(65) Prior Publication Data

US 2016/0107781 A1 Apr. 21, 2016

(30) Foreign Application Priority Data

Oct. 20, 2014 (DE) ..... 10 2014 221 218

(51) Int. Cl.
*B65B 65/00* (2006.01)
*B65B 35/30* (2006.01)
(Continued)

(52) U.S. Cl.
CPC ..... *B65B 65/003* (2013.01); *B65B 5/06* (2013.01); *B65B 5/068* (2013.01); *B65B 5/08* (2013.01);
(Continued)

(58) Field of Classification Search
CPC ..... B65B 65/003; B65B 65/006; B65B 5/06; B65B 5/068; B65B 5/08; B65B 21/04;
(Continued)

(56) References Cited

U.S. PATENT DOCUMENTS 2,978,854 A * 4/1961 Fairest ..... B65B 21/08 53/246
3,008,563 A * 11/1961 Carter ..... B65B 21/06 193/40
(Continued)

FOREIGN PATENT DOCUMENTS

CH 693710 12/2003
CN 203528876 4/2014
(Continued)

OTHER PUBLICATIONS

Screen captures from YouTube video clip entitled "Verpackungsstraße Varioline—Meistert alle Verpackungsaufgaben," 1 page, uploaded on Jul. 27, 2015 by user "Krones AG". Retrieved on Jan. 28, 2020 from Internet: <https://www.youtube.com/watch?v=jhrE1WiirpQ>. (Year: 2015).*
(Continued)

*Primary Examiner* — Stephen F. Gerrity
*Assistant Examiner* — Joshua G Kotis
(74) *Attorney, Agent, or Firm* — Simmons Perrine Moyer Bergman PLC

(57) ABSTRACT

The invention includes an apparatus (01) and a method for handling articles (02). The apparatus (01) includes a first conveyor (03) for supplying articles (02), a second conveyor (04) for supplying outer packagings (05), a third conveyor (06) for discharging filled outer packagings (07), and a placing surface (08) arranged between the second conveyor (04) and the third conveyor (06). The apparatus also includes a device (09) for transferring supplied outer packagings (05) from the second conveyor (04) to the placing surface (08), a device (10) for transferring articles (02) from the first conveyor (03) into outer packagings (05), and a device (11) for transferring filled outer packagings (07) from the placing surface (08) onto the third conveyor (06). The method places articles (02) into outer packagings (05), staged on a placing
(Continued)

surface (08), from one or more article flows lined up one after the other uninterruptedly and/or with gaps between them and/or grouped. The outer packagings (05) themselves in turn are supplied independently of the articles (02) in a transport direction (41) and are transferred (91) onto the placing surface (08) individually or groupwise transversely to the transport direction (41). After the articles (02) have been placed in the outer packagings (05), they are transferred (111), in turn individually or groupwise, transversely to the transport direction (41) in order to be subsequently discharged in the direction of the transport direction (41) or opposite to it in parallel to the transport direction (41).

18 Claims, 1 Drawing Sheet

(51) Int. Cl.

| | |
|---|---|
| ***B65B 43/42*** | (2006.01) |
| ***B65B 5/06*** | (2006.01) |
| ***B65B 21/18*** | (2006.01) |
| ***B65B 5/08*** | (2006.01) |
| ***B65B 35/36*** | (2006.01) |
| ***B65B 61/20*** | (2006.01) |
| ***B65B 43/54*** | (2006.01) |
| ***B65B 43/52*** | (2006.01) |
| *B65B 21/04* | (2006.01) |

(52) U.S. Cl.
CPC ..... *B65B 21/18* (2013.01); *B65B 35/30* (2013.01); *B65B 35/36* (2013.01); *B65B 43/42* (2013.01); *B65B 43/52* (2013.01); *B65B 43/54* (2013.01); *B65B 61/207* (2013.01); *B65B 21/04* (2013.01); *B65B 65/006* (2013.01)

(58) Field of Classification Search
CPC ..... B65B 21/18; B65B 35/30; B65B 35/36; B65B 35/44; B65B 35/54; B65B 43/52; B65B 61/207; B65B 2230/02; B65B 35/50; B65B 35/52; B65B 35/24–246; B65B 5/105; B31B 2120/25
USPC ..... 53/443, 473, 249–253, 246, 539, 263; 493/90–92, 912
See application file for complete search history.

(56) References Cited

U.S. PATENT DOCUMENTS 3,036,689 A * 5/1962 Carter ..... B65B 21/04 198/358
3,053,025 A * 9/1962 Nigrelli ..... B65B 5/106 198/419.3
3,066,811 A * 12/1962 Board ..... B65B 35/50 108/51.3
3,130,528 A * 4/1964 Andersen ..... B65B 21/186 53/55
3,350,836 A * 11/1967 Dillon ..... B65B 61/207 493/391
3,483,802 A * 12/1969 Heyne ..... B31B 50/00 198/468.8
3,626,661 A * 12/1971 Reichert ..... B65B 61/207 53/157
3,780,492 A * 12/1973 Corderoy ..... B65B 21/183 53/247
3,952,633 A * 4/1976 Nakai ..... B65B 61/207 493/91
4,048,780 A * 9/1977 Chenevard ..... B65B 5/062 53/247
4,147,265 A * 4/1979 McGill ..... B65G 47/842 198/474.1
4,815,251 A 3/1989 Goodman
4,901,504 A 2/1990 Tsuji et al.
4,907,398 A 3/1990 Holze et al.
5,060,455 A 10/1991 Schmeisser
5,212,930 A * 5/1993 Raudat ..... B65B 5/08 53/246
5,375,395 A 12/1994 Gmeiner
5,553,442 A 9/1996 Fadaie
5,588,282 A * 12/1996 Hartness ..... B65B 21/183 53/248
5,588,284 A * 12/1996 Klover ..... B65B 21/16 53/249
5,778,640 A * 7/1998 Prakken ..... B65B 5/061 53/244
5,797,249 A 8/1998 Hartness
6,061,996 A * 5/2000 Vissers ..... B65B 5/105 198/411
6,128,886 A * 10/2000 Johnson, Jr. ..... B65B 61/207 493/91
6,401,434 B1 6/2002 Sims
6,941,723 B2 9/2005 Stasio
7,302,785 B2 12/2007 Heuvel et al.
7,703,260 B1 * 4/2010 Watkins ..... B65B 21/183 53/250
8,286,409 B2 10/2012 Junghans
9,546,049 B2 1/2017 Lindauer
9,637,256 B2 5/2017 Wickeren et al.
2002/0108353 A1 * 8/2002 Franzaroli ..... B65B 25/146 53/435
2002/0157919 A1 * 10/2002 Sherwin ..... B65B 5/105 198/370.01
2004/0079053 A1 * 4/2004 Rohr ..... B65B 5/105 53/473
2005/0028495 A1 2/2005 Blanc
2005/0226711 A1 10/2005 Schnoor et al.
2005/0235607 A1 * 10/2005 Van Den Heuvel ..... B65B 61/207 53/415
2006/0070353 A1 4/2006 Van Dam
2006/0175179 A1 * 8/2006 Christman ..... B65B 25/146 198/436
2008/0190075 A1 * 8/2008 Waeckerlin ..... B65B 5/024 53/475
2008/0223002 A1 9/2008 Lanfranchi
2009/0205929 A1 * 8/2009 DeGuglielmo ..... B65B 5/024 198/347.1
2009/0249750 A1 10/2009 Black et al.
2009/0299521 A1 * 12/2009 Hansl ..... B65G 1/1373 700/215
2010/0180544 A1 * 7/2010 Devaux ..... B65B 39/006 53/251
2010/0234982 A1 * 9/2010 Sankaran ..... B65B 5/045 700/216
2011/0173930 A1 7/2011 Poutot
2012/0083920 A1 * 4/2012 Suyama ..... B25J 9/0084 700/230
2013/0283731 A1 10/2013 Bosch
2013/0298500 A1 * 11/2013 Laudet ..... B65B 5/06 53/284.5
2014/0059976 A1 * 3/2014 Raudat ..... B65B 5/06 53/244
2016/0200464 A1 * 7/2016 Bonnain ..... B65B 21/06 53/410

FOREIGN PATENT DOCUMENTS

| | | |
|---|---|---|
| CN | 203698762 | 7/2014 |
| DE | 3339045 | 5/1985 |
| DE | 4329179 | 3/1995 |
| DE | 10210353 | 9/2003 |
| DE | 202004021892 U1 | 7/2012 |
| DE | 202014000884 U1 | 5/2014 |
| EP | 0253229 | 1/1988 |
| EP | 0358540 | 3/1990 |
| EP | 0532785 | 3/1993 |
| EP | 1254854 A1 | 11/2002 |
| EP | 1410995 | 4/2004 |

(56) References Cited

FOREIGN PATENT DOCUMENTS

| | | | | |
|---|---|---|---|---|
| EP | 2233400 | A1 | 9/2010 | |
| GB | 715134 | A | 9/1954 | |
| GB | 999282 | A | 7/1965 | |
| GB | 1462677 | A | 1/1977 | |
| WO | 2003037723 | | 5/2003 | |
| WO | 2013010697 | | 7/2012 | |
| WO | WO-2013010697 | A1 * | 1/2013 | ..... B65B 5/105 |
| WO | 2014072518 | A2 | 5/2014 | |

OTHER PUBLICATIONS

European Patent Application EP15189563; Extended European Search Report dated May 6, 2016.
Corresponding Chinese Patent Application—Chinese First Office Action dated May 26, 2017.
European Patent Application Partial Search Report—EP 15 18 9563—dated Feb. 9, 2016.
German Patent Application Search Report—DE 10 2014 221 218. 9—dated May 29, 2015.
European Patent Application No. EP15189563.8 Notice of Opposition from EPO dated May 15, 2018.
EPO Notice of Opposition by KHS GmbH dated Oct. 24, 2018 and Attachment.
EPO Notice of Opposition by Schubert dated Oct. 22, 2018.
EPO Response to Schubert Notice of Opposition filed Oct. 31, 2018.
European Patent Application No. EP15189563.8 Notice of Opposition by Schubert from EPO dated May 15, 2018—English Translation.

* cited by examiner

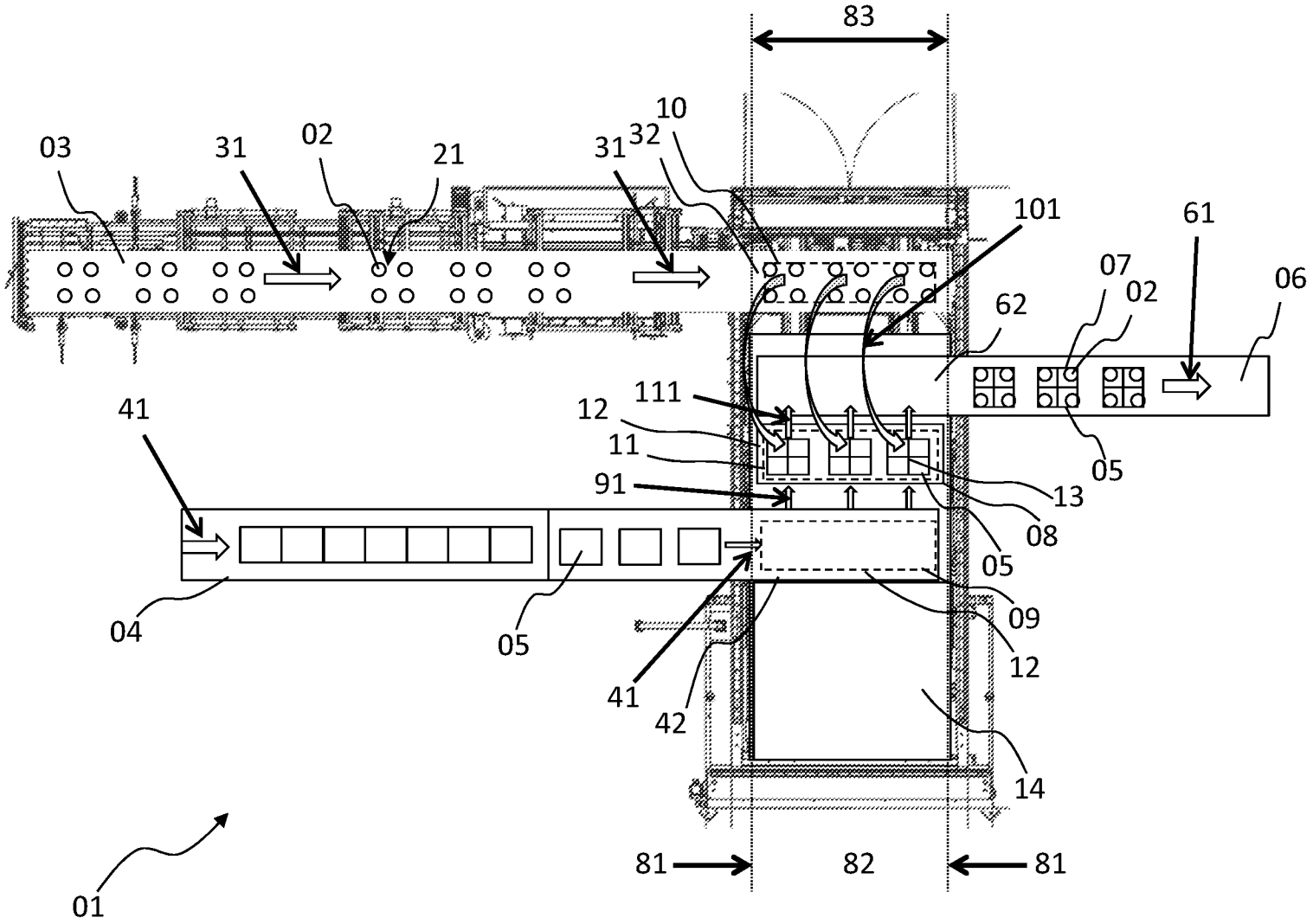
06
61
07
02
05
101
62
13
08
05
09
12
14
81
83
82
81
10
32
31
111
12
11
91
41
42
05
21
02
31
41
04
03
01

APPARATUS AND METHOD FOR HANDLING ARTICLES

PRIORITY CLAIM

The present application claims priority to German Application DE 10 2014 221 218.9, filed Oct. 20, 2014, which is incorporated by reference.

FIELD OF THE INVENTION

The present invention relates to an apparatus for handling articles and to a method for handling articles.

BACKGROUND OF THE INVENTION

The handling of articles frequently involves providing individual or a plurality of articles with an outer packaging, for instance, a cardboard packaging.

In the case of individual articles, this is carried out for their improved protection and/or for their improved sales presentation.

In the case of a plurality of articles, a bundle of a plurality of articles is additionally achieved by the outer packaging.

Bundles represent an effective way of enabling simultaneous handling of a plurality of articles, for instance, for facilitating the transport of a plurality of articles at the same time. For many articles, such as beverage containers, for example, bundles of a plurality of articles held together thus represent the most frequent type of sales units.

The articles can be objects, for instance, such as packaged or unpackaged objects, cardboard packagings, containers, such as beverage bottles or cans, or in themselves bundles, in turn, of a plurality of objects, in which the objects of a bundle can be held together, for instance, by means of an embracing around the periphery of a group of objects, such as, for instance, a strapping, an outer packaging, such as a wrapping, a shrink tube, or a cardboard packaging or a carrying rack, such as a beverage crate, to name but a few conceivable embodiments.

If a plurality of articles is assembled in an outer packaging, these articles can be placed into the outer packaging individually, one after the other, or groupwise, for instance, already according to their arrangement or according to a part of their arrangement in said outer packaging.

In handling articles, for instance, in food technology and/or beverage technology and/or packaging technology and/or in the food industry and/or beverage industry and/or packaging industry, pacing, i.e. being able to handle as many articles as possible within an as short as possible time span, represents a significant cost factor. The faster the pacing, the higher is the article throughput, and the better is thus the utilization of the machines, facilities, and devices intended for this purpose. Pacing can thus be described as the ratio of the number of articles to the period of time within which this number of articles is handled.

In order to be able to achieve high pacings, fully automatic devices, also called transplacing machines or, termed for short transplacers, are used in the packaging technology and in the packaging industry for transferring articles, which transplacers, in connection with the staging of outer packagings, continuously or discontinuously remove the article or the articles respectively to be transferred into an outer packaging within fractions of seconds from an infeed of articles being transported by means of, for instance, one or more conveyors in, for instance, one or more article flows of continuous, immediately consecutive articles or articles that are already grouped according to their number and/or already spaced apart from one another according to their later arrangement in the outer packaging, and transfer them into the outer packaging.

If this involves closeable outer packagings into which the articles are transferred, closing of the outer packagings can be carried out simultaneously with or subsequently to placing the complete number of articles to be transferred into the outer packaging.

An apparatus for handling articles that are fed to a continuously operating packaging machine is known from DE 42 04 993 C1. The apparatus comprises a transplacing machine with a plurality of gripper heads for respectively one group of articles to be transferred into an outer packaging having the form of a beverage crate. Each gripper head is arranged at a lever mechanism consisting of respectively four levers articulatedly connected with each other about parallel horizontal lever axes, two of which levers are pivotably arranged about likewise horizontal lever axes at a pivotal central carrier, which is rotatably driven about a central axis running in parallel to the lever axes. Arranged in parallel to the central carrier is a disk with control cams, into which disk pins engage, which are arranged at a part of the levers of each lever mechanism, and thus control a motion sequence of the gripper heads during a revolution of the central carrier about the central axis. The apparatus in addition comprises a first conveyor in the form of a horizontal conveyor belt, which feeds articles to the transplacing machine in a transport direction normal to the central axis and to the lever axes running in parallel thereto, and also, running below the first conveyor, a second conveyor, which transports the beverage crates in transport direction, too. The articles being transported by the conveyor belt are arranged in rows, are brought to a halt by a stop means at the end of the conveyor belt, and are received by one of the gripper heads after another. After a group of articles is received by a gripper head, the gripper head moves along in the transport direction of the conveyor belt, lifts up the received articles above the end of the conveyor belt while the stop means at the end of the conveyor belt is lowered, and subsequently lowers the articles to a subjacent level into a beverage crate being transported by means of the second conveyor, which continuously transports beverage crates in a horizontal direction. Subsequent to the lowering and controlled by the control cams, the gripper head first carries out a movement in parallel to the transport direction, while the articles, which were received by the gripper head and placed into an appropriate beverage crate being transported by the second conveyor, are released. Meanwhile, further articles advance at the end of the first conveyor. The transfer of the articles being received by a gripper head is completed by the gripper head being raised again, even while it is still moving in transport direction, and the filled beverage crate is transported away following the second conveyor. The further articles, which have advanced in the meantime, can be received by a further gripper head and disposed in a further, following beverage crate.

A similar apparatus is known from DE 43 29 179 A1, with the difference that the gripper heads are not arranged at a central carrier rotating about a horizontal central axis, but rather at a circulating traction means running in a vertical plane.

A similar apparatus is known from DE 33 39 045 A1, with the difference that the gripper heads are circulatingly guided in a horizontal direction at a chain, and are lowered and raised again as well as closed and opened by means of slides, which are guided along horizontally circulating rails.

A disadvantage of such apparatuses for handling articles is their large space requirement in the direction of transport as well as the limited pacing, as only one group of articles after the other is respectively transferred into a beverage crate.

A device for transferring articles is known from DE 102 10 353 A1, which device has a gripper head of a plurality of tulip-shaped grippers arranged at a six-axis robot arm, which tulip-shaped grippers are driven individually or groupwise movably in relation to each other within a plane formed by the tulip-shaped grippers during the transferring of the articles.

Even by means of such an apparatus, only one outer packaging after the other can be filled, thus greatly limiting the pacing.

SUMMARY OF THE INVENTION

One task of the invention is to specify an apparatus and a method for handling articles that allow a higher pacing when providing individual or a plurality of articles, for example articles grouped into an article group and/or into a bundle of assembled articles, with an outer packaging.

A first object of the invention accordingly relates to an apparatus for handling articles, comprising a first conveyor for the supply of articles, a second conveyor for the supply of outer packagings, and also a third conveyor for the discharge of outer packagings with articles placed therein.

The apparatus furthermore comprises a placing surface arranged between the second and the third conveyor as well as a device for transferring supplied outer packagings from the second conveyor to the placing surface.

Moreover, the apparatus comprises a device for transferring articles from the first conveyor into outer packagings having been transferred onto the placing surface.

The device for transferring articles first seizes the articles staged by means of the first conveyor, then transfers the seized articles from the first conveyor to the placing surface and, in the process of transferring the articles having been seized by the device and having been transferred from the first conveyor to the placing surface, places them into the outer packagings having been transferred onto the placing surface.

The apparatus further comprises a device for transferring outer packagings with articles placed therein from the placing surface onto the third conveyor.

The device for transferring outer packagings from the second conveyor onto the placing surface can comprise the device for transferring outer packagings with articles placed therein from the placing surface onto the third conveyor, or it can comprise one or more parts of the device for transferring outer packagings with articles placed therein from the placing surface onto the third conveyor, or it can be completely or partly comprised by the device for transferring outer packagings with articles placed therein from the placing surface onto the third conveyor.

The device for transferring supplied outer packagings from the second conveyor to the placing surface and the device for transferring outer packagings with articles placed therein from the placing surface onto the third conveyor thus each in themselves or together form at least one transfer device that is formed and operable independently of the device for transferring articles from the first conveyor into outer packagings having been transferred onto the placing surface.

The placing surface in connection with the at least one transfer device that is independent of the device for transferring articles from the first conveyor into outer packagings having been transferred onto the placing surface results in an increase in performance with regard to the pacing that is achievable based on an apparatus without placing surface. The higher pacing is achieved, because, by means of the placing surface in connection with the at least one transfer device that is independent of the device for transferring articles, articles supplied by means of the first conveyor can be seized by the device for transferring articles in a first cycle, and the device for transferring articles can begin with transferring the seized articles by starting a movement of the seized articles from the first conveyor to the placing surface while outer packagings that are still empty are simultaneously pushed off from the second conveyor to the placing surface and outer packagings with articles placed therein are pushed over from the placing surface onto the third conveyor, and in a second cycle new, empty outer packagings can be supplied by means of the second conveyor and outer packagings with articles placed therein can simultaneously be discharged from the third conveyor, while the transferring of the articles having been seized in the first cycle is simultaneously completed by placing articles into the outer packagings staged on the placing surface.

In this context, the transferring of the articles seized in the first cycle is concluded by placing the articles having been seized by the device for transferring articles into the empty outer packagings having been pushed off onto the placing surface in the first cycle, and by a return of the device for transferring articles from the placing surface to the first conveyor at least being started, in order to again seize and transfer articles supplied from the first conveyor.

Preferably, the first conveyor, the second conveyor, and the third conveyor are arranged in parallel to each other along the placing surface, at least in the area of their portions abutting on the placing surface. In the arrangement in parallel to each other, the transport directions of the conveyor run in parallel to each other at least in the area of their portions abutting on the placing surface. This applies to transport directions of all conveyors running in the same direction as well as to transport directions of at least two conveyors running in opposite directions.

The parallelly arranged portions of the conveyors preferably overlap one another by the length of at least two outer packagings. In this way, two or more outer packagings can be staged simultaneously on the placing surface, and articles can be simultaneously placed into the plurality of staged outer packagings. The pacing can thus be further increased.

The direction of the transfer of outer packagings, termed for short transfer direction and being carried out by the device for transferring empty outer packagings from the second conveyor to the placing surface, runs, in a horizontal direction, preferably transversely, preferentially in orthogonal to the transport direction of the second conveyor.

The direction of the transfer of outer packagings with articles placed therein, termed for short transfer direction and being carried out by the device for transferring outer packagings with articles placed therein from the placing surface to the third conveyor, runs, in a horizontal direction, preferably transversely, preferentially in orthogonal to the transport direction of the third conveyor.

In the transfer from the second conveyor to the placing surface and from the placing surface to the third conveyor, the transfer direction of the device or of the devices for transferring preferably both the empty outer packagings and the outer packagings with articles placed therein thus preferentially runs, in a horizontal direction, preferably transversely, preferentially in orthogonal to the transport directions of both the second conveyor and the third conveyor.

By the transversal and preferably orthogonal horizontal transfer direction in relation to the transport directions of the second and the third conveyor, a plurality of empty outer packagings as well as a plurality of outer packagings with articles placed therein can be respectively simultaneously transferred from the second conveyor to the placing surface as well as from the placing surface to the third conveyor, whereby articles can be simultaneously placed into a plurality of outer packagings that have been put down on the placing surface. The pacing can thus be significantly increased.

The device for transferring outer packagings from the second conveyor onto the placing surface and/or the device for transferring outer packagings with articles placed therein from the placing surface onto the third conveyor can comprise at least one slider.

The second and the third conveyor as well as the placing surface are preferentially located on a common, first level, whereas the first conveyor is preferably located on a higher, second level. A vertical stroke of the device for transferring articles, which vertical stroke is necessary for placing articles into outer packagings, can thus be reduced to the essential, whereby the pacing can be further increased.

Preferably, the second level is located above the first level by at least the height of an outer packaging, which is initially open and to be closed after placing the articles therein, as the case may be. In the instance of flaps for closing that protrude to the top from an outer packaging designed as a closeable cardboard packaging, the second level is preferentially located accordingly higher, by the height of the flaps protruding above the first level, than in the instance of the outer packaging being closed, for instance, with a separately provided lid.

The closing of the outer packagings with articles placed therein can be carried out while still on the placing surface, for instance, together with or subsequent to placing the articles, or in a separate treatment step, for instance, subsequent to or in the further course of the third conveyor of the apparatus for handling articles. For instance, the outer packagings with articles placed therein can be closed with lids in the further course of the third conveyor.

Prior to placing the articles into outer packagings having been transferred onto the placing surface, compartments, also termed so-called baskets, can be inserted into the outer packagings, which compartments assign fixed positions to the articles within the outer packagings and thus protect them, during the further transport of the outer packagings with articles placed therein until the articles are withdrawn and consumed, from colliding with each other and rubbing against each other, which otherwise would lead to a negative impression of the quality by scuffing, for instance, of information applied onto the articles in the form of labels, for example, and/or by the articles damaging each other.

The compartments can already have been or be inserted into the outer packagings prior to the transfer of the outer packagings to the placing surface, or the compartments can be inserted into the outer packagings prior to or together with or after the articles being placed into the outer packagings. The subsequent introduction of compartments, in particular with lightweight articles that are shiftable with little effort within the outer packagings, has the advantage of a simpler placing of the articles in the outer packagings, along with a reduced effort for controlling, because articles with a shape, for example, tapering conically or in a similar manner toward their oppositely located contact surfaces, such as beverage bottles with a bottle neck widening at least sectionwise from the top downward, can be horizontally shifted within the outer packagings by the compartments when these are inserted.

The compartments can be introduced into the outer packagings, for instance, while still on the second conveyor, or they can be introduced into the outer packagings, for instance, already together with or subsequent to erecting these, or they can already be integrated into an according cardboard packaging, wherein the compartments unfold within the outer packaging when the cardboard packaging is erected.

In connection with introducing compartments prior to or after placing articles into the outer packagings, a separate introduction surface can alternatively be provided between the second conveyor and the placing surface, in the instance of the introduction prior to placing the articles, or between the placing surface and the third conveyor, in the instance of the introduction after placing the articles. Accordingly, an additional device for transfer, which can also be part of a transfer device or comprised by it, can be provided.

In the further course of the third conveyor of the apparatus for handling articles, a stacking station can be provided, where, for instance, closed outer packagings with articles placed therein are grouped into stack layers and stacked onto a stack, which is then discharged in order to make room for stacking up a new stack after reaching a specified stacking height according to a specified number of stack layers stacked on top of each other at the stacking station.

The articles supplied by means of the first conveyor are preferentially already sorted into article groups to be respectively placed into an outer packaging. The articles supplied by means of the first conveyor can abut on each other or they can be supplied lined up one after the other with gaps between them. The articles supplied by means of the first conveyor can be supplied in one row or in a plurality of rows running in parallel. For this purpose, the articles can be transferred to the first conveyor via a suitable infeed, and be guided in one or in a plurality of lanes oriented in parallel to each other after the transfer to the first conveyor.

The articles supplied by means of the first conveyor accordingly form a single- or multiple-row article flow of articles lined up one after the other uninterruptedly and/or with gaps between them.

Before the articles are subsequently placed into the outer packagings by means of the apparatus for handling articles, the said articles can have been previously treated along an infeed to the first conveyor, for instance, by producing a container and/or cleaning an outer and/or inner surface and/or cooling and/or filling and/or closing, in order to name only a few examples of treating articles without claim to completeness of the list, and/or the articles can have been previously handled along an infeed to the first conveyor, for instance, by separating a number of articles from one or more article flows of articles being transported immediately following each other and/or grouping a number of articles into article groups and/or compiling and assembling a number of articles into bundles, in order to name only a few examples of handling articles without claim to completeness.

The conveyor preferentially comprise at least one horizontal conveyor device, such as, for instance, a belt conveyor and/or a roller conveyor.

The outer packagings can preferentially be cardboard packagings, for instance, in the form of cardboard boxes with or without compartments arranged or arrangeable therein for separating and/or keeping apart individual articles from each other.

It is obvious that the invention can be realized by an apparatus for handling articles with:

a first conveyor supplying articles in a first transport direction, a second conveyor supplying outer packagings in a second transport direction preferentially directed in parallel to and running in the same direction as or opposite to the first transport direction, a third conveyor discharging outer packagings with articles placed therein in a third transport direction preferentially directed in parallel to and running in the same direction as or opposite to the first and second transport direction, a placing surface arranged between the second conveyor, a device for transferring supplied outer packagings from the second conveyor to the placing surface, a device for transferring articles from the first conveyor into outer packagings having been transferred onto the placing surface, and a device for transferring outer packagings with articles placed therein from the placing surface onto the third conveyor, wherein the device for the transfer of supplied outer packagings from the second conveyor to the placing surface and the device for the transfer of outer packagings with articles placed therein from the placing surface onto the third conveyor can be combined in one common transfer device.

A second object of the invention relates to a method for handling articles, which method provides that articles are placed into outer packagings staged on a placing surface, which articles are supplied in one or in a plurality of article flows of articles lined up one after the other uninterruptedly and/or with gaps between them and/or grouped, which outer packagings themselves in turn are supplied independently of the articles in a transport direction and are transferred onto the placing surface individually or groupwise transversely to the transport direction and, after the articles have been placed therein, they are transferred from there in turn individually or groupwise transversely to the transport direction—now provided with articles placed therein—in order to be subsequently discharged in the direction of the transport direction or opposite to it in parallel to the transport direction independently of the supply of articles, independently of the supply of outer packagings, and independently of the placing of articles into the outer packagings.

Both the apparatus and the method can alternatively or additionally have individual or a combination of a plurality of features initially described in connection with the prior art and/or in one or more documents mentioned regarding the prior art.

Moreover, the apparatus can alternatively or additionally have individual or a combination of a plurality of features previously described in connection with the method, as well as the method can alternatively or additionally have individual or a combination of a plurality of features previously described in connection with the apparatus.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention. The same or equivalent elements of the invention are designated by identical reference characters. Furthermore and for the sake of clarity, only the reference characters relevant for describing the respective FIGURE are provided. It should be understood that the detailed description and specific examples of the device and method according to the invention, while indicating preferred embodiments, are intended for purposes of illustration only and are not intended to limit the scope of the invention.

The FIGURE shows a schematic illustration of: a top view of an apparatus according to the invention for handling articles.

DETAILED DESCRIPTION OF THE INVENTION

An apparatus 01 for handling articles 02, as illustrated completely or in parts in the FIGURE comprises:

a first conveyor 03 for the supply of articles 02, a second conveyor 04 for the supply of outer packagings 05, a third conveyor 06 for the discharge of outer packagings 05 with articles 02 placed therein, termed for short, filled outer packagings 07, and a placing surface 08 arranged between the second conveyor 04 and the third conveyor 06, as well as a device 09, illustrated by a dashed line, for the transfer indicated by arrows 91 of supplied outer packagings 05 from the second conveyor 04 to the placing surface 08, a device 10, illustrated by a dashed line, for the transferring indicated by arrows 101 of articles 02 from the first conveyor 03 into outer packagings 05 having been transferred onto the placing surface 08, and a device 11, illustrated by a dashed line, for the transfer indicated by arrows 111 of filled outer packagings 07, from the placing surface 08 onto the third conveyor 06.

The device 10 for the transferring indicated by arrows 101 of articles 02 first seizes the articles 02 staged by means of the first conveyor 03, then transfers the seized articles 02 from the first conveyor 03 to the placing surface 08 and, in the process, places the articles 02 having been seized and having been transferred from the first conveyor 03 to the placing surface 08 by it into the outer packagings 05 having been transferred onto the placing surface 08.

The apparatus 01 allows carrying out a method for handling articles 02, which method provides that articles 02 are placed into outer packagings 05 staged on a placing surface 08, which articles 02 are supplied in one or in a plurality of article flows of articles 02 lined up one after the other uninterruptedly and/or with gaps between them and/or grouped, which outer packagings 05 themselves in turn are supplied independently of the articles 02 in a transport direction indicated by arrows 41 and are transferred, as indicated by arrows 91, onto the placing surface 08 individually or groupwise transversely to the transport direction indicated by arrows 41 and, after the articles 02 have been placed therein, they are transferred, as indicated by arrows 111, from there in turn individually or groupwise transversely to the transport direction indicated by arrows 41—now provided with articles 02 placed therein—in order to be subsequently discharged in the direction of the transport direction indicated by arrows 41 or opposite to it in parallel to the transport direction indicated by arrows 41 independently of the supply indicated by arrows 31 of articles 02, independently of the supply indicated by arrows 41 of outer packagings 05, and independently of the placing indicated by arrows 41 of articles 02 into the outer packagings 05.

Both the apparatus 01 and the method can be further developed as explained in the following.

The device 09 for the transfer indicated by arrows 91 of outer packagings 05 from the second conveyor 04 onto the placing surface 08 can comprise the device 11 for the transfer indicated by arrows 111 of filled outer packagings 07, from the placing surface 08 onto the third conveyor 06 or one or more parts of the device 11 for the transfer indicated by arrows 111 of filled outer packagings 07, from the placing surface 08 onto the third conveyor 06.

Alternatively, the device 09 for the transfer indicated by arrows 91 of outer packagings 05 from the second conveyor 04 onto the placing surface 08 can be completely or partly comprised by the device 11 for the transfer indicated by arrows 111 of filled outer packagings 07, from the placing surface 08 onto the third conveyor 06.

The device 09 for transferring supplied outer packagings 05 from the second conveyor 04 to the placing surface 08 and the device 11 for transferring filled outer packaging items 07 from the placing surface 08 onto the third conveyor 06 thus each in themselves or together form at least one transfer device 12 that is formed and drivable independently of the device 10 for transferring articles 02 from the first conveyor 03 into outer packagings 05 having been transferred onto the placing surface 08.

The placing surface 08 in connection with the at least one transfer device 12 that is independent of the device 10 for transferring articles 02 from the first conveyor 03 into outer packagings 05 having been transferred onto the placing surface 08 results in an increase in performance with regard to the pacing that is achievable based on an apparatus without placing surface 08. The higher pacing is achieved, because, by means of the placing surface 08 in connection with the at least one transfer device 12 that is independent of the device 10 for transferring articles 02, articles 02 supplied by means of the first conveyor 03 can be seized by the device 10 for transferring articles 02 in a first cycle, and the device 10 for transferring articles 02 can begin with transferring the seized articles 02 by starting a movement of the seized articles 02 from the first conveyor 03 to the placing surface 08 while outer packagings 05 that are still empty are simultaneously transferred, for instance, by pushing off or over, from the second conveyor 04 to the placing surface 08 and outer packagings 07 are transferred by pushing off or over from the placing surface 08 onto the third conveyor 06, and in a second cycle new, empty outer packagings 05 can be supplied by means of the second conveyor 04 and outer packagings 07 can simultaneously be discharged from the third conveyor 06, while the transferring of the articles 02 having been seized in the first cycle is simultaneously completed by placing articles 02 by means of the device 10 for transferring articles 02 into the outer packagings 05 staged on the placing surface 08.

In this context, the transferring of the articles 02 seized in the first cycle is concluded by placing the articles 02 having been seized by the device 10 for transferring articles 02 into the empty outer packagings 05 having been transferred by pushing off or over onto the placing surface 08 in the first cycle, and by a return of the device 10 for transferring articles 02 from the placing surface 08 to the first conveyor 03 at least being started, in order to again seize and, in a repetition of the first cycle, transfer articles 02 supplied from the first conveyor 03.

The transfer indicated by arrows 91 from the second conveyor 04 to the placing surface 08 can be carried out by pushing over supplied outer packagings 05.

The transferring as indicated by arrows 101 can be carried out by gripping the articles 02, pushing the gripped articles over the edge of the first conveyor 03 or by slightly lifting the gripped articles from the first conveyor 03 as well as lowering them into the outer packagings 05 staged on the placing surface 08.

The transfer indicated by arrows 111 from the placing surface 08 to the third conveyor 06 can be carried out by pushing over outer packagings 07.

Preferentially, at least the second conveyor 04 and the third conveyor 06 are arranged in parallel to each other along the placing surface 08, at least in the area of their portions 32, 42, 62 abutting on the placing surface 08 or, in other words, the second conveyor 04 and the third conveyor 06 run in parallel to each other at least in the area of their portions 32, 42, 62 abutting on the placing surface 08.

In addition, the first conveyor 03 can run in parallel to the second conveyor 04 and in parallel to the third conveyor 06.

In the arrangement in parallel to each other, the transport directions indicated by arrows 31, 41, 61 of the conveyors 03, 04, 06 run in parallel to each other at least in the area 82 located between the arrows 81 of their portions 32, 42, 62 abutting on the placing surface 08, or, as the case may be, of their portions 32, 42, 62 overlapping each other in the area of the placing surface 08. This applies to transport directions of all conveyors 03, 04, 06 running in the same direction as well as to transport directions of at least two conveyors 03, 04, 06 running in opposite directions.

The parallelly arranged portions 32, 42, 62 of the conveyors 03, 04, 06 can overlap one another by a distance indicated by the double arrow 83 of the length of at least two, preferably at least three outer packagings 05 staged on the placing surface 08.

In this way, two or more outer packagings 05 can be simultaneously transferred from the second conveyor 04 onto the placing surface 08 and two or more outer packagings 07 can be simultaneously transferred from the placing surface 08 to the third conveyor 06, and likewise articles 02 can be simultaneously placed into the plurality of outer packagings 05 that are thus staged on the placing surface 08. The pacing can thus be further increased.

The direction of the transfer of outer packagings 05, termed for short transfer direction, indicated by arrows 91, and being carried out by the device 09 for transferring empty outer packagings 05 from the second conveyor 04 to the placing surface 08, runs, in a horizontal direction, preferably transversely, preferentially in orthogonal to the transport direction indicated by arrows 41 of the second conveyor 04.

The direction of the transfer of outer packagings 07, which direction is termed for short transfer direction, is indicated by arrows 111, and is being carried out by the device 11 for transferring filled outer packagings 07, from the placing surface 08 to the third conveyor 06, runs, in a horizontal direction, preferably transversely, preferentially in orthogonal to the transport direction indicated by the arrow 61 of the third conveyor 06.

In the transfer from the second conveyor 04 to the placing surface 08 and in the transfer from the placing surface 08 to the third conveyor 06, the transfer direction indicated by arrows 91 and by arrows 111 of the device or devices 09 for transferring preferably both the empty outer packagings 05 and the filled outer packagings 07, thus preferentially runs, in a horizontal direction, preferably transversely, preferentially in orthogonal to the transport directions indicated by arrows 41 and 61 of both the second conveyor 04 and the third conveyor 06.

By the transversal and preferably orthogonal horizontal transfer direction indicated by arrows 91 and by arrows 111 in relation to the transport directions indicated by arrows 41 and 61 of the second conveyor 04 and the third conveyor 06, one or more empty outer packagings 05 as well as one or more filled outer packagings 07, can be respectively simultaneously transferred from the second conveyor 04 to the placing surface 08 as well as from the placing surface 08 to the third conveyor 06, whereby articles 02 can be simultaneously placed into a plurality of outer packagings 05 that have been put down on the placing surface 08. The pacing can thus be significantly increased.

For instance, the device 09 for transferring outer packagings 05 from the second conveyor 04 onto the placing surface 08 and/or the device 11 for transferring filled outer packagings 07, from the placing surface 08 onto the third conveyor 06 can comprise at least one slider.

The second conveyor 04 and the third conveyor 06 as well as the placing surface 08 are preferentially located on a common, first level.

The first conveyor 03 is preferably located on a higher, second level.

A vertical stroke of the device 10 for transferring articles 02, which vertical stroke is necessary for placing articles 02 into outer packagings 05, can thus be reduced to the essential, whereby the pacing can be further increased.

The second level can be located above the first level by at least the height of an outer packaging 05, which is initially open and to be closed after placing the articles 02 therein, as the case may be.

In the instance of flaps for closing that protrude to the top from an outer packaging 05 designed as a closeable cardboard packaging, the second level is preferentially located accordingly higher, by the height of the flaps protruding above the first level, than in the instance of the outer packagings 05 being closed, for instance, with a separately provided lid.

The closing of the filled outer packagings 07, can be carried out while still on the placing surface 08, for instance, together with or subsequent to placing the articles 02 into the outer packagings 05, or in a separate treatment step, for instance, subsequent to or in the further course of the third conveyor 06 of the apparatus 01 for handling articles 02.

For instance, the filled outer packagings 07, can be closed with lids in the further course of the third conveyor 06.

Prior to placing the articles 02 into outer packagings 05 having been transferred onto the placing surface 08, compartments 13, also termed so-called baskets, can be inserted into the outer packagings 05, which compartments 13 assign fixed positions to the articles 02 within the outer packagings 05 and thus protect them, during the further transport of the filled outer packagings 07 until the articles 02 are withdrawn and consumed, from colliding with each other and rubbing against each other, which otherwise would lead to a negative impression of the quality by scuffing, for instance, of information applied onto the articles 02 in the form of labels, for example, and/or by the articles 02 damaging each other.

The compartments 13 can already have been or be inserted into the outer packagings 05 prior to the transfer of the outer packagings 05 to the placing surface 08, or the compartments 13 can be inserted into the outer packagings 05 prior to or together with or after the articles 02 being placed into the outer packagings 05.

The compartments 13 can be staged, for instance, by a separate device 14, which can simultaneously erect the compartments 13, for instance.

The subsequent introduction of compartments 13, in particular with lightweight articles 02 that are shiftable with little effort within the outer packagings 05, has the advantage of a simplified placing of the articles 02 in the outer packagings 05, along with a reduced controlling effort for the device 10 for transferring the articles 02, because articles 02 with a shape, for example, tapering conically or in a similar manner toward their oppositely located contact surfaces, such as beverage bottles with a bottle neck widening at least sectionwise from the top downward, can be horizontally shifted within the outer packagings 05 by the compartments 13 when these are inserted.

The compartments 13 can be introduced into the outer packagings 05, for instance, while still on the second conveyor 04, or they can be introduced into the outer packagings 05, for instance, already together with or subsequent to erecting these, or they can already be integrated into an according cardboard packaging, wherein the compartments 13 unfold within the outer packaging 05 with the cardboard packaging being erected.

In connection with introducing compartments 13 prior to or after placing articles 02 into the outer packagings 05, a separate introduction surface can alternatively be provided between the second conveyor 04 and the placing surface 08 in the instance of the introduction of compartments 13 prior to placing the articles 02, or between the placing surface 08 and the third conveyor 06 in the instance of the introduction of compartments 13 after placing the articles 02.

In this context, an additional device can be provided for the transfer of outer packagings 05 provided with compartments 13 from the introduction surface to the placing surface 08 or from the placing surface 08 to the introduction surface, which additional device can also be part of a transfer device 12 or be comprised by it.

In the further course of the third conveyor 06 of the apparatus 01 for handling articles 02, a stacking station can be provided, where, for instance, filled outer packagings 07, taking the form of closed outer packagings 05 with articles 02 placed therein, are grouped into stack layers and stacked onto a stack, which is then discharged in order to make room for stacking up a new stack after reaching a specified stacking height according to a specified number of stack layers stacked on top of each other at the stacking station.

The articles 02 supplied by means of the first conveyor 03 are preferentially already sorted into article groups 21 to be respectively placed into an outer packaging 05. The articles 02 supplied by means of the first conveyor 03 can abut on each other or they can be supplied lined up one after the other with gaps between them. The articles 02 supplied by means of the first conveyor 03 can be supplied in one row or in a plurality of rows running in parallel. For this purpose, the articles 02 can be transferred to the first conveyor 03 via a suitable infeed, and be guided in one or in a plurality of lanes oriented in parallel to each other after the transfer to the first conveyor 03.

The articles 02 supplied by means of the first conveyor 03 accordingly form a single- or multiple-row article flow of articles 02 lined up one after the other uninterruptedly and/or with gaps between them.

Before the articles 02 are subsequently placed into the outer packagings 05 by means of the apparatus 01 for handling articles 02, the said articles 02 can have been previously treated along an infeed to the first conveyor 03, for instance, by producing a container and/or cleaning an outer and/or inner surface and/or cooling and/or filling and/or closing, in order to name only a few examples of treating articles 02 without claim to completeness of the list, and/or the articles 02 can have been previously handled along an infeed to the first conveyor 03, for instance, by separating a number of articles 02 from one or more article flows of articles 02 being transported immediately following each other and/or grouping a number of articles 02 into article groups 21 and/or compiling and assembling a number of articles 02 into bundles, in order to name only a few examples of handling articles 02 without claim to completeness.

The conveyors 03, 04, 06 preferentially comprise at least one horizontal conveyor device, such as, for instance, a belt conveyor and/or a roller conveyor.

The outer packagings 05 can preferentially be cardboard packagings, for instance, in the form of cardboard boxes with or without compartments 13 arranged or arrangeable therein for separating and/or keeping apart individual articles 02 from each other.

It is obvious that the invention can be realized by an apparatus 01 for handling articles 02 with:

a first conveyor 03 supplying articles 02 in a first transport direction indicated by arrows 31, a second conveyor 04 supplying outer packagings 05 in a second transport direction indicated by arrows 41 and preferentially directed in parallel to and running in the same direction as or opposite to the first transport direction indicated by arrows 31, a third conveyor 06 discharging filled outer packagings 07, in a third transport direction indicated by an arrow 61 and preferentially directed in parallel to and running in the same direction as or opposite to the first transport direction indicated by arrows 31 and to the second transport direction indicated by arrows 41, a placing surface 08 arranged between the second conveyor 04 and the third conveyor 06, a device 09 for the transfer indicated by arrows 91 of supplied outer packagings 05 from the second conveyor 04 to the placing surface 08, a device 10 for the transferring indicated by arrows 101 of articles 02 from the first conveyor 03 into outer packagings 05 having been transferred onto the placing surface 08, and a device 11 for the transfer indicated by arrows 111 of filled outer packagings 07, from the placing surface 08 onto the third conveyor 06, wherein the device 09 for the transfer of supplied outer packagings 05 from the second conveyor 04 to the placing surface 08 and the device 11 for the transfer of filled outer packagings 07, from the placing surface 08 onto the third conveyor 06 can be combined in one common transfer device 12.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

The invention claimed is:

1. A method for handling articles (02), comprising:

supplying, on a first conveyor (03), articles (02) from one or more article flows of articles (02) wherein the articles are lined up one after the other uninterruptedly or with gaps between individual articles (02) or the articles are grouped, supplying, on a second conveyor (04), empty outer packages (05) in a transport direction (41) and transferring the empty outer packages (05) onto a placing surface (08) individually or groupwise, orthogonally to the transport direction (41), seizing articles (02) from the one or more article flows, transferring the seized articles (02) into empty outer packages (05) staged on the placing surface (08) by moving the articles, individually or groupwise, orthogonally to the transport direction (41), transferring the filled outer packages (07) from the placing surface (08) to a third conveyor (06), individually or groupwise, orthogonally to the transport direction (41), and discharging, on the third conveyor (06), the filled outer packages (07) in the direction of the transport direction (41) or in parallel to the transport direction (41), wherein the third conveyor (06), is independently operable of the first conveyor (03), is independently operable of the second conveyor (04), and is independently operable of a device for the transferring of the seized articles (02) into the outer packages (05), and further comprising:

inserting compartments (13) into the outer packages (05) staged on a separate introduction surface, prior to or after the seizing and transferring steps, wherein, in a first cycle, the transferring of the seized articles begins while the empty outer packages (05) are simultaneously transferred to the placing surface (08) and while the filled outer packages (07) are simultaneously transferred to the third conveyor (06), and in a second cycle, the transferring of the seized articles of the first cycle ends while empty outer packages (05) are simultaneously transferred to the placing surface (08) from the second conveyor (04) and while the outer packages (07) filled in the first cycle are simultaneously transferred to the third conveyor (06), wherein during the transferring of the seized articles, the seized articles are transferred over the third conveyor and to the placing surface.

2. The method of claim 1 further comprising transferring the outer packages (05) with compartments (13) from the introduction surface to the placing surface (08) or from the placing surface (08) to the introduction surface.

3. The method of claim 1 wherein the first conveyor (03) is independently operable of the second conveyor (04).

4. The method of claim 3 wherein the first conveyor (03) and the second conveyor (04) are arranged in parallel to each other, at least in an area that abuts the placing surface (08).

5. The method of claim 4 wherein the third conveyor (06) is arranged in parallel to the first conveyor (03) and to the second conveyor (04), at least in an area that abuts the placing surface (08).

6. The method of claim 5 wherein the second conveyor (04), the third conveyor (06), and the placing surface (08) are on a common, first level, and the first conveyor (03) is on a higher, second level.

7. The method of claim 6 wherein the second level is located above the first level by at least the height of an open outer packaging (05).

8. The method of claim 5 wherein the second level is located above the first level by at least the height of an open outer packaging (05).

9. The method of claim 4 wherein the second conveyor (04), the third conveyor (06), and the placing surface (08) are on a common, first level, and the first conveyor (03) is on a higher, second level.

10. The method of claim 1 further comprising a closing step carried out while the filled outer packages (07) are still on the placing surface (08).

11. The method of claim 10 further comprising stacking the closed filled outer packages (07).

12. A method for handling articles (02), comprising:

supplying, on a first conveyor (03), articles (02) from one or more article flows of articles (02) wherein the articles are lined up one after the other uninterruptedly or with gaps between individual articles (02) or the articles are grouped, supplying, on a second conveyor (04), empty outer packages (05) in a transport direction (41) and transferring the empty outer packages (05) onto a placing surface (08) individually or groupwise, orthogonally to the transport direction (41), seizing articles (02) from the one or more article flows, transferring the seized articles (02) into empty outer packages (05) staged on the placing surface (08) by moving the articles, individually or groupwise, orthogonally to the transport direction (41), transferring the filled outer packages (07) from the placing surface (08) to a third conveyor (06), individually or groupwise, orthogonally to the transport direction (41), and discharging, on the third conveyor (06), the filled outer packages (07) in the direction of the transport direction (41) or in parallel to the transport direction (41), wherein the third conveyor (06), is independently operable of the first conveyor (03), is independently operable of the second conveyor (04), and is independently operable of a device for the transferring of the seized articles (02) into the outer packages (05), and further comprising:

inserting compartments (13) into the outer packages (05) staged on a separate introduction surface, prior to or after the seizing and transferring steps, wherein, in a first cycle, the transferring of the seized articles begins while the empty outer packages (05) are simultaneously transferred to the placing surface (08) and while the filled outer packages (07) are simultaneously transferred to the third conveyor (06), and in a second cycle, the transferring of the seized articles of the first cycle ends while empty outer packages (05) are simultaneously transferred to the placing surface (08) from the second conveyor (04) and while the outer packages (07) filled in the first cycle are simultaneously transferred to the third conveyor (06), wherein a portion of the third conveyor is located between a portion of the first conveyor and a portion of the second conveyor along a direction orthogonal to the transport direction.

13. The method of claim 12 further comprising transferring the outer packages (05) with compartments (13) from the introduction surface to the placing surface (08) or from the placing surface (08) to the introduction surface.

14. The method of claim 12 wherein the first conveyor (03) is independently operable of the second conveyor (04).

15. The method of claim 14 wherein the first conveyor (03) and the second conveyor (04) are arranged in parallel to each other, at least in an area that abuts the placing surface (08).

16. The method of claim 15 wherein the third conveyor (06) is arranged in parallel to the first conveyor (03) and to the second conveyor (04), at least in an area that abuts the placing surface (08).

17. The method of claim 12 further comprising a closing step carried out while the filled outer packages (07) are still on the placing surface (08).

18. The method of claim 17 further comprising stacking the closed filled outer packages (07).

* * * * *